US007626326B2

(12) United States Patent
Jeon et al.

(10) Patent No.: US 7,626,326 B2
(45) Date of Patent: Dec. 1, 2009

(54) ELECTRON EMISSION DISPLAY

(75) Inventors: Sang-Ho Jeon, Suwon-si (KR); Sang-Jo Lee, Suwon-si (KR); Jin-Hui Cho, Suwon-si (KR); Sang-Hyuck Ahn, Suwon-si (KR); Su-Bong Hong, Suwon-si (KR); Sam-Il Han, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 335 days.

(21) Appl. No.: 11/822,563

(22) Filed: Jul. 6, 2007

(65) Prior Publication Data

US 2008/0061676 A1 Mar. 13, 2008

(30) Foreign Application Priority Data

Sep. 12, 2006 (KR) ..... 10-2006-0088067

(51) Int. Cl.
*H01J 1/62* (2006.01)

(52) U.S. Cl. ..... 313/496; 313/495

(58) Field of Classification Search ..... 313/461, 313/463, 495, 496
See application file for complete search history.

(56) References Cited

U.S. PATENT DOCUMENTS

2006/0267476 A1* 11/2006 Jeon et al. ..... 313/495

* cited by examiner

*Primary Examiner*—Vip Patel
(74) *Attorney, Agent, or Firm*—Lee & Morse, P.C.

(57) ABSTRACT

An electron emission display includes an electron emission unit on a first substrate adapted to emit electron beams, a light emission unit on a second substrate, the light emission unit including a plurality of photoluminescent layers facing the electron and emission unit, a plurality of spacers between the first and second substrates along a first direction, wherein each photoluminescent layer of the plurality of photoluminescent layers satisfies a proviso that (a−b)/2>c, where "a" is a length of the photoluminescent layer in a second direction, "b" is a magnitude of an electron beam spot on the photoluminescent layer in the second direction, and "c" is a shifting distance of the electron beam spot in the second direction.

20 Claims, 8 Drawing Sheets

ELECTRON EMISSION DISPLAY

BACKGROUND OF THE INVENTION

1. Field of the Invention

Embodiments of the present invention relate to an electron emission display. More particularly, embodiments of the present invention relate to an electron emission display with enhanced luminance uniformity.

2. Description of the Related Art

Generally, electron emission displays refer to devices capable of displaying images by extracting and accelerating electrons from a cathode, hot or cold, toward photoluminescent layers in a vacuum environment. Electron emission displays employing cold cathodes refer to devices having cathode electrodes that, instead of employing heater (or hot cathodes), emit electrons by application of a strong electric field between cathode and gate electrodes.

A conventional electron emission display may include an electron emission unit on a first substrate, a light emission unit with photoluminescent layers on a second substrate, and a sealing member connecting the first and second substrates, so that the electron emission unit and the light emission unit may be enclosed in a vacuum envelop between the first and second substrates. The conventional electron emission display may further include a plurality of spacers between the first and second substrates to support compression force applied to the vacuum envelope. The conventional spacers may be formed of a dielectric substance, e.g., glass or ceramic, to prevent a short circuit between driving electrodes on the first substrate and an anode electrode on the second substrate.

However, some of the electrons extracted and accelerated toward the photoluminescent layers may collide with the spacers, thereby charging the spacers with a positive or negative potential with respect to the material characteristic thereof, e.g., a dielectric constant, a secondary electron emission coefficient, and so forth. The charged spacers may alter the electric field in the electron emission display, so that extracted electrons may be accelerated along modified trajectories. In other words, the electrons may not properly collide with the photoluminescent layers, thereby distorting the light emitted from the photoluminescent layers adjacent to the charged spacers. Such light distortion, e.g., color, intensity, and so forth, may trigger non-uniform luminance and reduced display quality. Accordingly, there exists a need to improve the structure of the electron emission display in order to improve luminance uniformity thereof.

SUMMARY OF THE INVENTION

Embodiments of the present invention are therefore directed to an electron emission display, which substantially overcomes one or more of the disadvantages of the related art.

It is therefore a feature of an embodiment of the present invention to provide an electron emission display having a structure capable of providing improved luminance uniformity.

At least one of the above and other features and advantages of the present invention may be realized by providing an electron emission display, including an electron emission unit on a first substrate adapted to emit electron beams, a light emission unit on a second substrate, the light emission unit having a plurality of photoluminescent layers facing the electron emission unit, and a plurality of spacers between the first and second substrates along a first direction, wherein each photoluminescent layer of the plurality of photoluminescent layers satisfies a proviso that $(a-b)/2>c$, where "a" is a length of the photoluminescent layer in a second direction, "b" is a magnitude of an electron beam spot on the photoluminescent layer in the second direction, and "c" is a shifting distance of the electron beam spot in the second direction. The electron emission display may further include a sealing member affixing the first and second substrates to provide a vacuum environment therebetween.

The electron emission unit may include field emission array elements. Each photoluminescent layer may correspond to a respective field emission array element. The electron emission unit may include a plurality of first electrodes, a plurality of second electrodes intersecting a direction of the first electrodes, and electron emission regions electrically connected to the first or the second electrodes.

The electron emission unit may include surface-conduction emission elements. Each photoluminescent layer may correspond to a respective surface-conduction emission element. The electron emission unit may include a plurality of first electrodes, a plurality of second electrodes intersecting a direction of the first electrodes, first conductive layers electrically connected to the first electrodes, second conductive layers electrically connected to the second electrodes, and electron emission regions between the first and second conductive layers.

The electron emission unit may further include a third electrode above the first and second electrodes. The light emission unit may also include black layers between the photoluminescent layers. Further, the light emission unit may include a reflection layer in communication with the photoluminescent layers and the black layers.

The plurality of the photoluminescent layers may be arranged in a matrix pattern. The photoluminescent layers may be spaced apart from each other and arranged in a plurality of arrays along the first direction. Each spacer may be perpendicular to the photoluminescent layers. Further, each spacer may be between arrays of photoluminescent layers. Each spacer may be between two arrays of photoluminescent layers. The spacers may have a long rod-type structure. The spacers may have a short rod-type structure. Each photoluminescent layer may have a rectangular shape.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
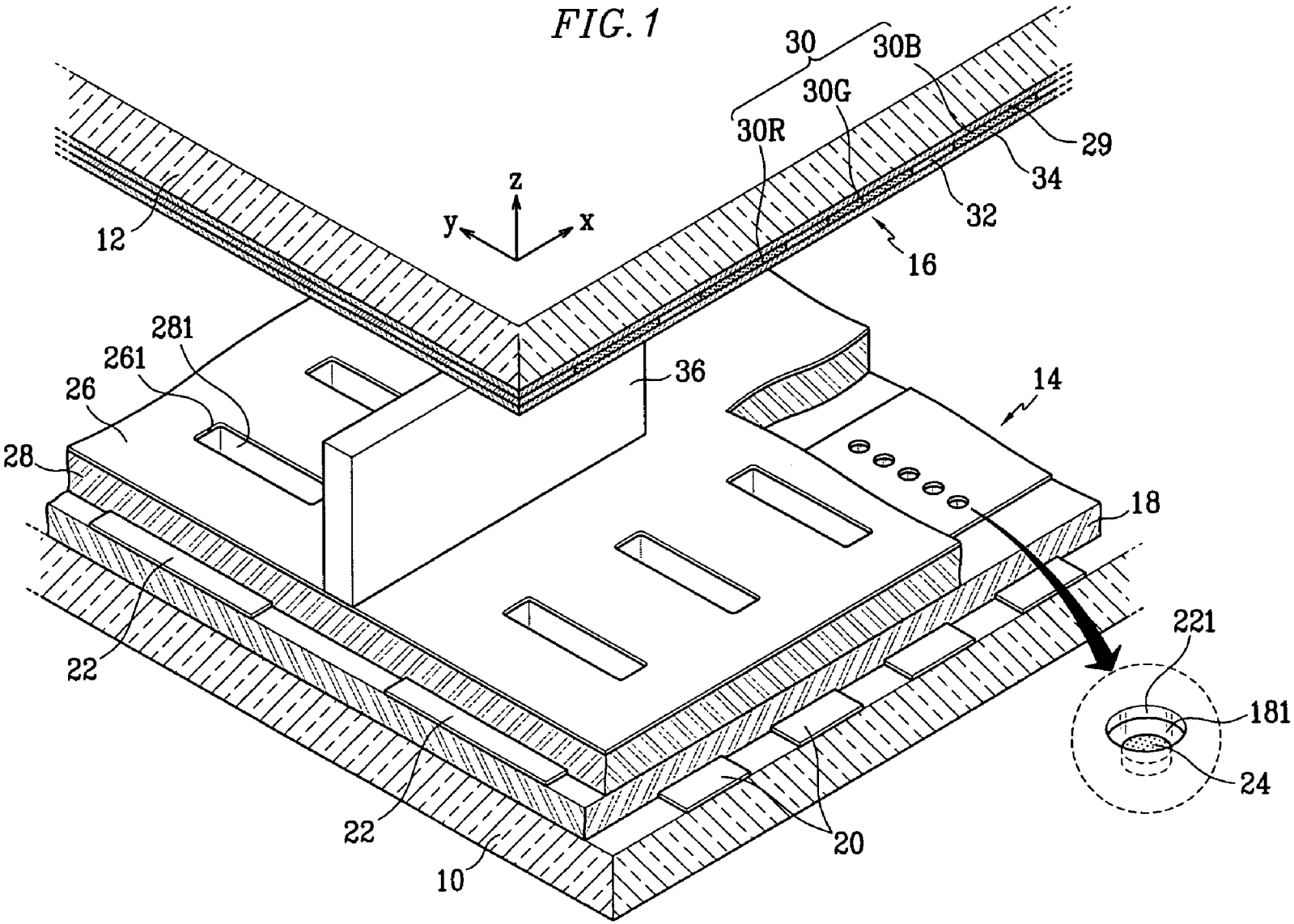
FIG. 1 illustrates a partial exploded perspective view of an electron emission display according to an embodiment of the present invention.

Korean Patent Application No. 10-2006-0088067, filed on Sep. 12, 2006, in the Korean Intellectual Property Office and entitled: "Electron Emission Display" is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions are exaggerated for clarity of illustration. It will also be understood that when a layer or element is referred to as being "on" another layer, element, or substrate, it can be directly on the other layer, element, or substrate, or intervening layers or elements may also be present. Further, it will be understood that when a layer or element is referred to as being "under" another layer or element, it can be directly under, or one or more intervening layers or elements may also be present. In addition, it will also be understood that when a layer or element is referred to as being "between" two layers or elements, it can be the only layer or element between the two layers or elements, or one or more intervening layers or elements may also be present. Like reference numerals refer to like elements throughout.

Figure 2:
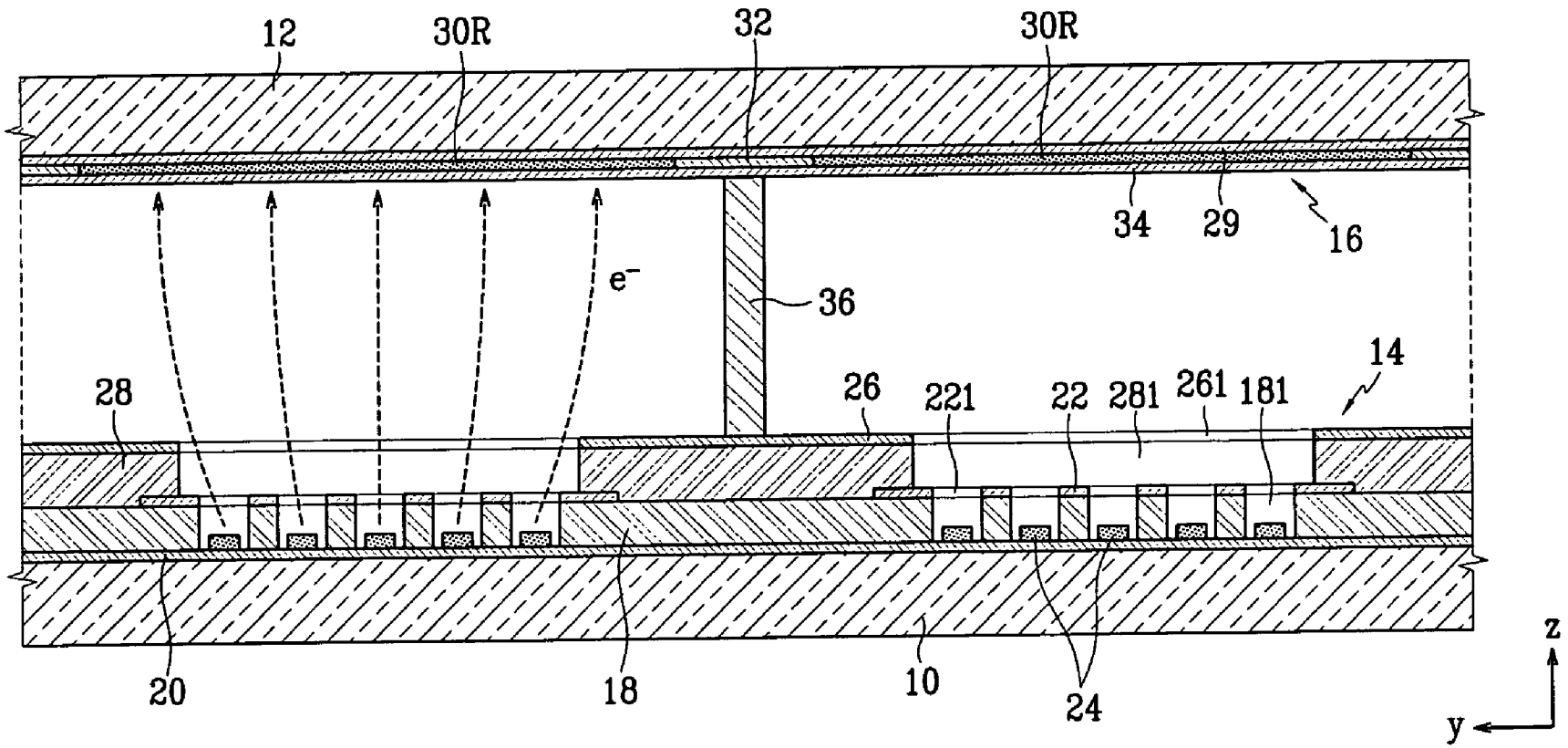
FIG. 2 illustrates a partial cross-sectional view along a y-axis of FIG. 1.

An exemplary embodiment of an electron emission display according to the present invention is more fully described below with reference to FIGS. 1-3. As illustrated in FIGS. 1-2, an electron emission display according to an embodiment of the present invention may include an electron emission unit 14 on a first substrate 10, a light emission unit 16 on a second substrate 12, and a plurality of spacers 36 therebetween.

The first and second substrates 10 and 12 may face each other, and may be spaced apart from each other at a predetermined interval. A sealing member (not shown) may be provided at peripheral portions of inner surfaces of the first and the second substrates 10 and 12 to provide connection therebetween. In other words, the first and second substrates 10 and 12 may be affixed to each other, such that the electron emission unit 14 and the light emission unit 16 may be enclosed in a vacuum envelope between the first and second substrates 10 and 12. The vacuum envelope, i.e., an inner space between the sealed first and second substrates 10 and 12, may be maintained at about $10^{-6}$ Torr.

The electron emission unit 14 may include an array of electron emission elements, and may be positioned on the first substrate 10. More specifically, the electron emission unit 14 may include a plurality of first electrodes 20 on the first substrate 10, an insulating layer 18 on the first substrate 10 to coat the plurality of first electrodes 20, a plurality of second electrodes 22 on the insulating layer 18, and a plurality of electron emission regions 24 electrically connected to at least one of each of the pluralities of first and second electrodes 20 and 22. A structure including one first electrode 20 of the plurality of first electrodes 20, one second electrode 22 of the plurality of second electrodes 22, and at least one electron emission region 24 may be defined as one field emission array (FEA) element, i.e., one sub-pixel.

The plurality of the first electrodes 20 of the electron emission unit 14 may be stripe-patterned, so that each first electrode 20 may be positioned along a second direction, e.g., in parallel to the y-axis. The plurality of second electrodes 22 may be stripe-patterned, so that each second electrode 22 may be positioned along a first direction perpendicular to the second direction, e.g., in parallel to the x-axis. Accordingly, the first and second electrodes 20 and 22 may cross one another. It should be noted, however, that while directions of the first and second electrodes 20 and 22 may be perpendicular, the first and second electrodes 20 and 22 may be insulated from one another.

The electron emission regions 24 of the electron emission unit 14 may be formed either on the first electrodes 20 or on the second electrodes 22. For example, as illustrated in FIG. 2, the electron emission regions 24 may be formed on the first electrodes 20, so that the first electrodes 20 may be cathode electrodes electrically connected to the electron emission regions 24 to supply current thereto. Accordingly, the second electrodes 22 may be gate electrodes electrically insulated from the electron emission regions 24 to form a potential difference between the first and second electrodes 20 and 22, i.e., the cathode and gate electrodes, to facilitate electron extraction from the electron emission regions 24. If the electron emission regions 24 are formed on the second electrodes 22, the second electrodes 22 may function as cathode electrodes, and the first electrodes 20 may function as gate electrodes. Further, one electrode of the plurality of first electrodes 20 may function as a scan electrode to receive scan driving voltage, while one electrode of the plurality of second electrodes 22 may function as a data electrode to receive data driving voltage. Alternatively, one electrode of the plurality of first electrodes 20 may function as a data electrode, while one electrode of the plurality of second electrodes 22 may function as a scan electrode.

The electron emission regions 24 may be formed of a material capable of emitting electrons upon application of an electric field under a vacuum atmosphere, e.g., a carbonaceous material or a nanometer-sized material. More specifically, the electron emission regions 24 may be formed of one or more of carbon nanotubes, graphite, graphite nanofibers, diamonds, diamond-like carbon, $C_{60}$, silicon nanowires, a molybdenum-based material, and/or a silicon-based material. If the electron emission regions 24 are formed of a molybdenum-based material or a silicon-based material, the electron emission regions 24 may be formed to have a pointed-tip structure.

The electron emission unit 14 of the electron emission display may further include at least one first opening 181 and at least one second opening 221, as illustrated in FIGS. 1-2. The first openings 181 may be formed through the insulating layer 18 in areas corresponding to intersection points of the first and second electrodes 20 and 22. The second openings 221 may be formed through the second electrode 22 in areas corresponding to the intersection points of the first and second electrodes 20 and 22. The first and second openings 181 and 221 may overlap, so that respective upper surfaces of the first electrodes 20 may be partly exposed therethrough. In other words, the first and second openings 181 and 221 may be formed directly above the electron emission regions 24 to expose portions of the first electrodes 20, as illustrated in FIG.

2, so that emitted electrons may move from the electron emission regions 24 upward through the first and second openings 181 and 221.

The electron emission unit 14 of the electron emission display may further include a second insulating layer 28 and a third electrode 26, as illustrated in FIGS. 1-2. The second insulating layer 28 may be formed on the first insulating layer 18 to coat the second electrodes 22, so that the second electrodes 22 may be positioned between the first and second insulating layers 18 and 28. The third electrode 26 may be disposed on the second insulating layer 28, and may function as a focusing electrode. At least one third opening 281 and at least one fourth opening 261 may be formed through the second insulating layer 28 and the third electrode 26, respectively, to facilitate passage of an electron beam from the electron emission regions 24 therethrough.

More specifically, the third electrode 26 may include a plurality of fourth openings 261, so that each fourth opening 261 may be formed to correspond to a single respective electron emission region 24 to separately focus electrons emitted therefrom. Alternatively, as illustrated in FIGS. 1-2, a single fourth opening 261 may be formed to correspond to a plurality of respective emission regions 24, i.e., a sub-pixel, to collectively focus electrons emitted from the sub-pixel. The at least one third opening 281 and at least one fourth opening 261 may be formed along a length of the first electrode 20, i.e., y-axis, to expose the plurality of electron emission regions 24 of each sub-pixel. Accordingly, if the electron emission unit 14 includes the second insulating layer 28 and the third electrode 26, emitted electrons may move from the electron emission regions 24 upward through the first, second, third, and fourth openings 181, 221, 281, and 261.

The light emission unit 16 of the electron emission display may include a plurality of light emission elements, and may be positioned on the second substrate 12. More specifically, the light emission unit 16 may include a plurality of photoluminescent layers 30, a plurality of black layers 32 between the photoluminescent layers 30, and an anode electrode 29. The light emission unit 16 may further include a reflection layer 34.

The photoluminescent layers 30 may include red, blue, and green photoluminescent layers 30R, 30B, and 30G formed of, e.g., a phosphorescent material, on a surface of the second substrate 12. The red, blue, and green photoluminescent layers 30R, 30B, and 30G may be positioned to define respective red, blue, and green sub-pixels, so that three sub-pixels having different colors may form a single pixel. Further, as illustrated in FIG. 3, the photoluminescent layers 30 may be disposed on the second substrate 12 in a matrix form, e.g., a plurality of rows along the x-axis.

The photoluminescent layers 30, i.e., sub-pixels, may have a substantially similar rectangular shape, i.e., a pair of longitudinal sides parallel to the y-axis and a pair of lateral sides parallel to the x-axis. Therefore, each individual photoluminescent layer 30 may be positioned along the y-axis, as further illustrated in FIG. 3.

The plurality of black layers 32 of the light emission unit 16 may be formed on the surface of the second substrate 12 adjacent to the photoluminescent layers 30 to enhance the contrast of the screen. For example, the plurality of black layers 32 may be formed between the photoluminescent layers 30, such that each black layer 32 may be between two photoluminescent layers 30, as illustrated in FIGS. 1-2. The plurality of the photoluminescent and black layers 30 and 32 may be positioned on one side of the anode electrode 29 that faces the first substrate 10.

The anode electrode 29 of the light emission unit 16 may be formed of a transparent conductive material, e.g., indium tin oxide (ITO). Further, the anode electrode 29 may receive high voltage to place the photoluminescent layers 30 at a high electric potential state, thereby facilitating acceleration of electron beams from the first substrate 10 toward the second substrate 12 and generation of visible light in the photoluminescent layers 30.

The reflection layer 34 of the light emission unit 16 may be formed of a reflective material, e.g., aluminum, to a thickness of about several thousands angstroms. Further, the reflection layer 34 may include a plurality of apertures to facilitate passage of electron beams from the first substrate 10 to the second substrate 12. The reflection layer 34 may enhance screen luminance. More specifically, a portion of the visible light emitted from the photoluminescent layers 30, i.e., light emitted toward the first substrate 10, may be reflected by the reflection layer 34 toward the second substrate 12. The reflection layer 34 may also function as an anode electrode, so that formation of the anode electrode 29 as a separate element may be eliminated.

Figure 3:
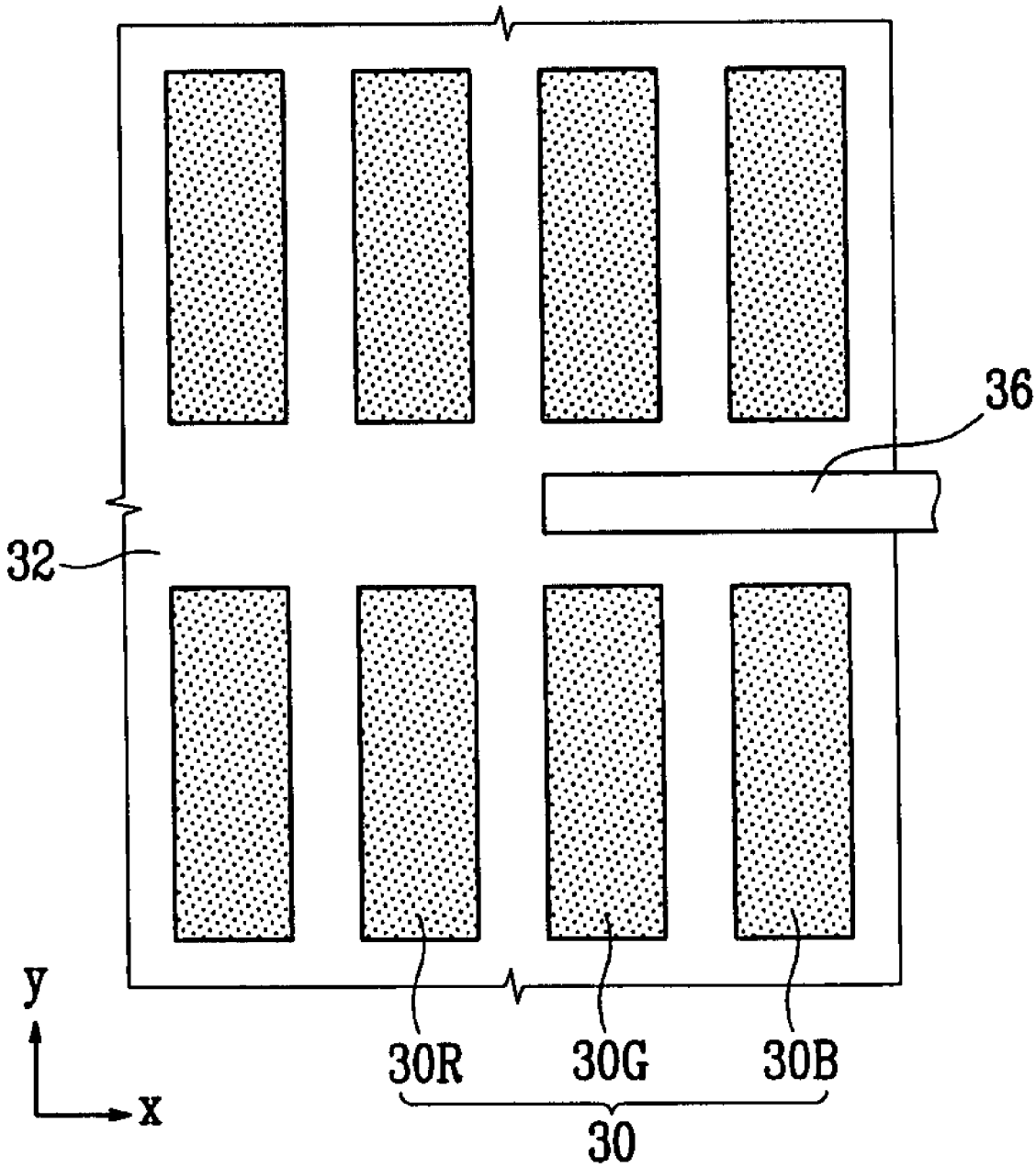
FIG. 3 illustrates a schematic partial bottom view of an arrangement of the photoluminescent layers of FIG. 1 with respect to a spacer.

The plurality of spacers 36 of the electron emission display may be disposed between the first and second substrates 10 and 12 along the first direction, i.e., each spacer 36 may be positioned in parallel to the x-axis, as illustrated in FIG. 3. The spacers 36 may support the structure of the electron emission display, e.g., prevent structure collapse resulting from compression inside the vacuum envelope of the electron emission display, maintain a uniform predetermined gap between the first and second substrates 10 and 12, and so forth. Each spacer 36 may be positioned to correspond to a respective black layer 32 in order to minimize interference with light emitted from the photoluminescent layers 30. In other words, as illustrated in FIG. 2, a contact plane between each spacer 36 and the light emission unit 16 may be through a respective black layer 32 along the z-axis in order to prevent any overlap between the spacer 36 and the photoluminescent layers 30. Further each spacer 36 may be positioned between arrays of photoluminescent layers 30, e.g., each spacer 36 may be positioned between two arrays of photoluminescent layers 30. Therefore, a direction of each spacer 36 may be perpendicular to a direction of each photoluminescent layer 30, as illustrated in FIG. 3.

Figure 4:
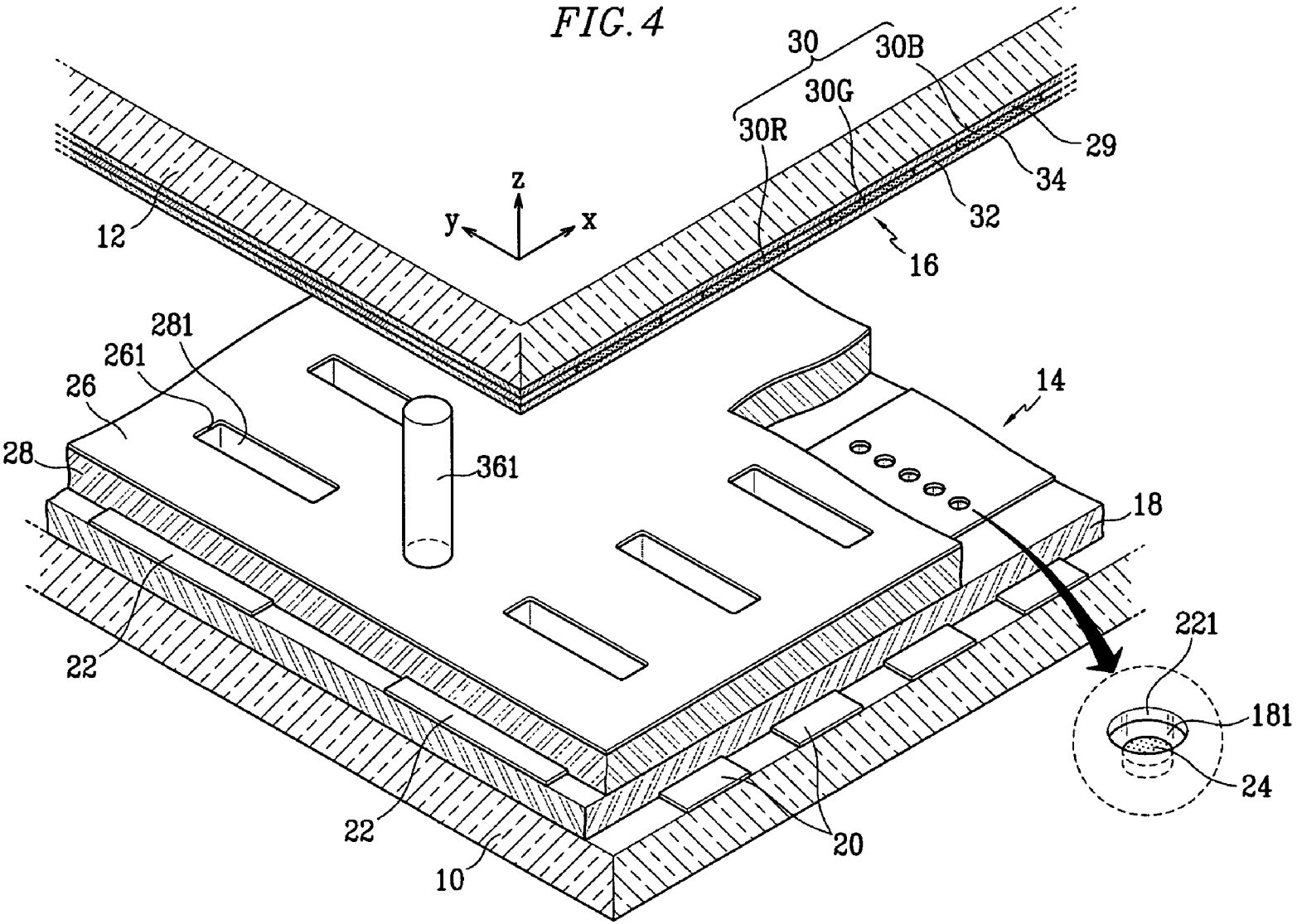
FIG. 4 illustrates a partial exploded perspective view of an electron emission display including a spacer formed to have a cylindrical-type structure.

Each spacer 36 may be formed of a dielectric material, e.g., glass, ceramic, or tempered glass, and may be formed to have a predetermined structure, e.g., a long rod-type, a short rod-type, or a cylindrical-type. A long rod-type structure may refer to a spacer 36 having a longitudinal structure with a length that may be substantially equal to a length of the first substrate 10 along the x-axis, i.e., the long rod-type structured spacer 36 may be adjacent to all the photoluminescent layers 30 positioned in an array along the x-axis. A short rod-type structure may refer to a spacer 36 having a longitudinal structure with a length that may be substantially shorter than a length of the first substrate 10 along the x-axis, i.e., the short rod-type structured spacer 36 may be adjacent to only part of the photoluminescent layers 30 positioned in an array along the x-axis. FIG. 4 illustrates an electron emission display including a spacer 361 formed to have a cylindrical-type structure.

For example, as illustrated in FIGS. 1-3, a spacer 36 having a short rod-type structure may have a predetermined height, i.e., a distance along the z-axis, corresponding to a distance between the first and second substrates 10 and 12. Further, each such spacer 36 may extend along the x-axis between arrays of photoluminescent layers 30, e.g., the spacer 36 may be adjacent to two photoluminescent layers 30 in each array.

The electron emission display may be driven by applying a predetermined voltage to the first, second, third, and anode electrodes 20, 22, 26, and 29 as follows. A scan electrode, i.e., either one of the first and second electrodes 20 and 22, may receive a scan driving voltage. A data electrode, i.e., either the first or the second electrode 20 and 22 not operating as a scan electrode, may receive a data driving voltage. The third electrode 26 may receive 0V or a negative DC voltage, e.g., about several volts to about tens of volts. The anode electrode 29 may receive a positive DC voltage, e.g., about several hundreds of volts to about several thousands of volts. The application of voltage may form an electric field around the electron emission regions 24, so that a voltage difference between the first and second electrodes 20 and 22 may facilitate electron emission, i.e., electron beams, from the electron emission regions 24. The high voltage applied to the anode electrode 29 may accelerate electrons emitted from the electron emission regions 24 toward the light emission unit 16, as illustrated in FIG. 2, so that the emitted electrons may strike the photoluminescent layers 30. Collision between the electrons and the photoluminescent layers 30 may excite the photoluminescent layers 30 to emit visible light.

More specifically, electrons emitted from the electron emission regions 24 toward the photoluminescent layers 30 may form an electron beam of a predetermined size, so that an electron beam spot may be formed to overlap with the photoluminescent layers 30 to facilitate collision of electrons with the photoluminescent layers 30. Despite focusing of the third electrode 26, potentially random collisions of electrons with the spacers 36 may occur and charge the spacers 36, so that the electron beam may shift along the second direction with respect to the spacers 36, i.e., closer or further from the spacers 36 with respect to charge thereof. According to an embodiment of the present invention and without intending to be bound by theory, it is believed that formation of the electron emission display with photoluminescent layers 30 satisfying Equation 1 may maintain a substantially complete overlap between the electron beam and the photoluminescent layers 30 despite the shift of the electron beam, thereby providing uniform light emission from the photoluminescent layers 30, as will be discussed below with respect to FIGS. 5A-5C. In this respect, it should be noted that a "substantially complete overlap" refers to positioning of the entire electron beam spot substantially within the photoluminescent layer 30, so that no substantial portions of the electron beam spot may overlap with the black layers 32 along the y-axis.

Figure 5A:
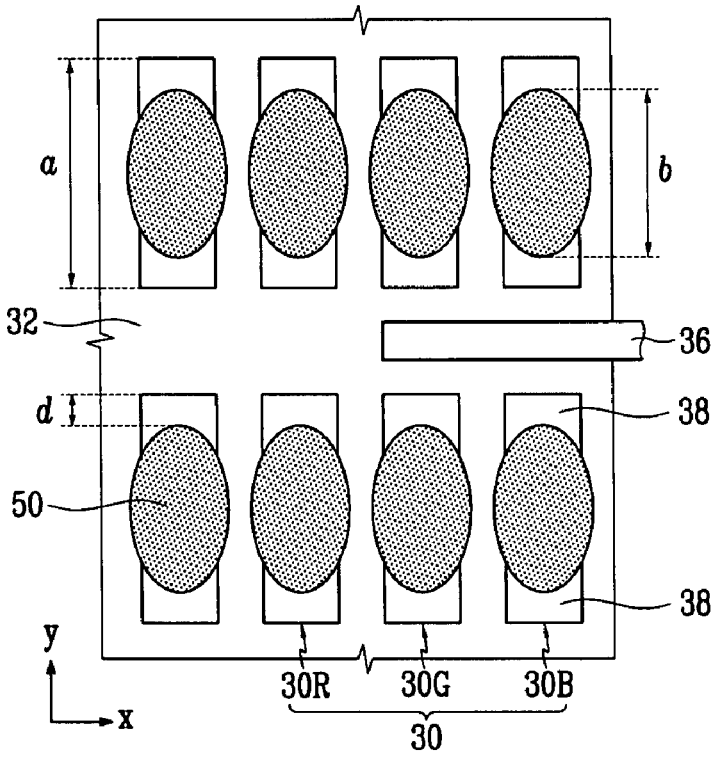
FIG. 5A illustrates a schematic partial bottom view of an electron beam spot with respect to photoluminescent layers of FIG. 1 and an uncharged spacer.
Figure 5B:
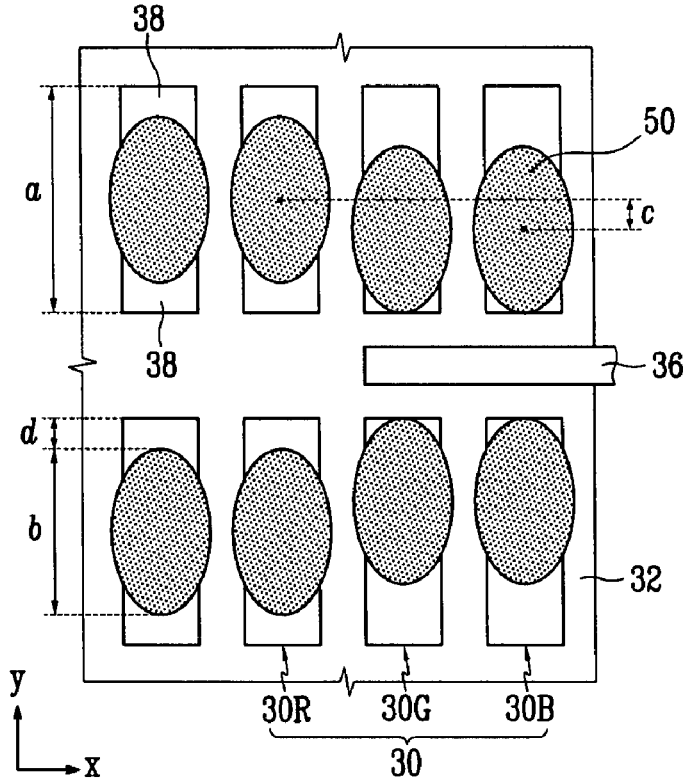
FIGS. 5B-5C illustrate schematic partial bottom views of an electron beam spot with respect to photoluminescent layers of FIG. 1 and a positively/negatively charged spacer, respectively.
Figure 5C:
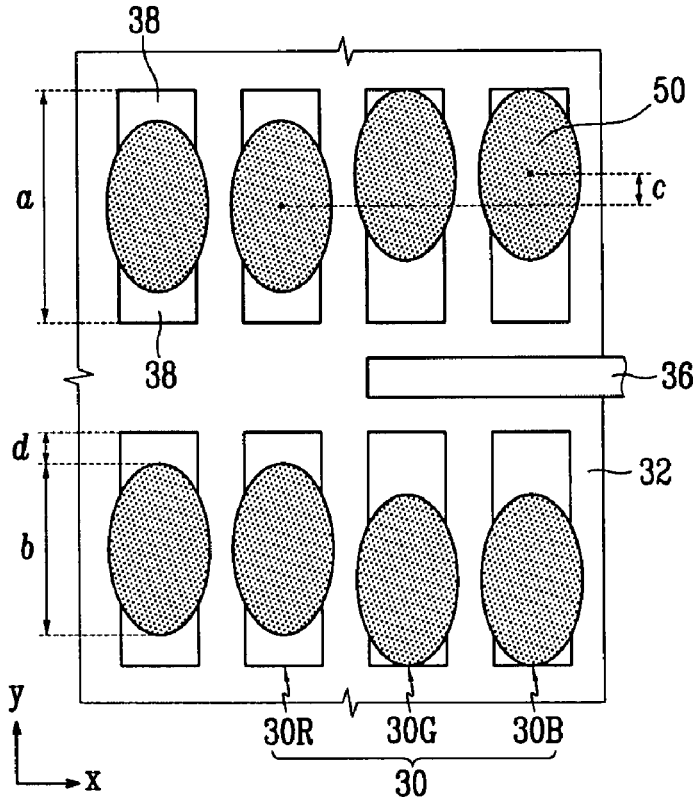

In detail, each photoluminescent layer 30 may be formed to satisfy the condition of equation 1 below.

$$\frac{a-b}{2} > c \qquad \text{Equation 1}$$

where, as illustrated in FIGS. 5A-5C, "a" indicates a length of the photoluminescent layer 30 in the second direction, i.e., along the y-axis, "b" indicates a magnitude of an electron beam spot along the second direction, e.g., a radius of the electron beam spot 50, and "c" indicates a maximum shifting distance of the electron beam spot 50 along the second direction with respect to an adjacent charged spacer 36. In this respect, it should be noted that in FIGS. 5A-5C, it is assumed that the following parameters are substantially uniform: structure and driving conditions of the sub-pixels, a gap between the first and second substrates 10 and 12, and structure of spacers 36. The size and shifting distance of the electron beam spots 50 in the second direction on respective photoluminescent layers 30, i.e., "b" and "c" respectively, are assumed to be constant and uniform as determined by the electron emission display structure and specification.

In further detail, according to Equation 1, as long as the length "a" of the photoluminescent layer 30 is larger than the magnitude "b" of the electron beam spot 50 in the second direction, each photoluminescent layer 30 may have a portion thereof, i.e., a color-lacking region 38, not in contact with the electron beam spot 50, as further illustrated in FIGS. 5A-5C. Further, as long as movement of the electron beam spot 50, i.e., shifting distance "c," is within the color-lacking region 38, a substantially complete overlap between the photoluminescent layers 30 and the electron beam spots 50 may be achieved, thereby providing proper electron collisions with the photoluminescent layers 30. In other words, a substantially complete overlap between the photoluminescent layers 30 and the electron beam spots 50 as provided by satisfying Equation 1 may generate substantially uniform intensity and color of light emitted from all the photoluminescent layers 30, thereby providing uniform luminance. Such a structure is specifically advantageous when the spacers 36 may have a short rod-type structure, i.e., when a potentially non-uniform luminance may be caused because only a portion of the photoluminescent layers 30 may be adjacent to the spacers 36.

More specifically, as illustrated in FIG. 5A, when the spacer 36 is not charged, a center of the photoluminescent layer 30 may be aligned with a center of the electron beam spot 50, so that the color-lacking region 38 may be defined symmetrically around the electron beam spot 50. In other words, the electron beam spot 50 may be positioned in a center of the photoluminescent layer 30, so that the color-lacking region 38 may have a length "d" at each side of the electron beam spot 50, as further illustrated in FIG. 5A. Accordingly, the length "d" of the color-lacking region 38 may equal [(a−b)/2]. Therefore, Equation 1 may be rewritten as "d">"c." In other words, as long as a dimensional relationship between the photoluminescent layer 30 and the electron beam spot 50 is such that the length "d" is larger than the shifting distance "c" of the electron beam spot 50, a substantially complete overlap between the photoluminescent layer 30 and the electron beam spot 50 may be achieved for proper light emission.

For example, as illustrated in FIGS. 5B-5C, when the photoluminescent layer 30 satisfies Equation 1, a maximum movement of the electron beam spot 50 along the y-axis, i.e., the shifting distance "c" either up or down along the y-axis, may still provide a substantially complete overlap between the photoluminescent layer 30 and the electron beam spot 50. In other words, when an edge of the photoluminescent layer 30 corresponds to a respective edge of the electron beam spot 50, so that the color-lacking region 38 may be substantially only at one side of the electron beam spot 50, i.e., the color-lacking region 38 may equal "2d," the overlap between the photoluminescent layer 30 and the electron beam spot 50 may be sufficient to provide uniform luminance.

In this respect, it is noted that uniform luminance may be determined with respect to a surface area of the overlapping photoluminescent layer 30 and the electron beam spot 50. For example, an overlapping area of the electron beam spot 50 and each of the green and blue photoluminescent layers 30G and 30B adjacent to the spacer 36, as further illustrated in FIGS. 5B-5C, may be comparable to the overlapping area of the electron beam spot 50 and the red photoluminescent layer 30R, despite an attraction/repulsion forces between the green and blue photoluminescent layers 30G and 30B and the spacers 36. As a result, the electron emission display according to embodiments of the present invention may exhibit minimized electron collisions against incorrect surfaces, e.g., black layers 32, thereby reducing color and/or image distortion, e.g., showing of a location of the spacers 36 on a screen.

EXAMPLES

Figure 6:
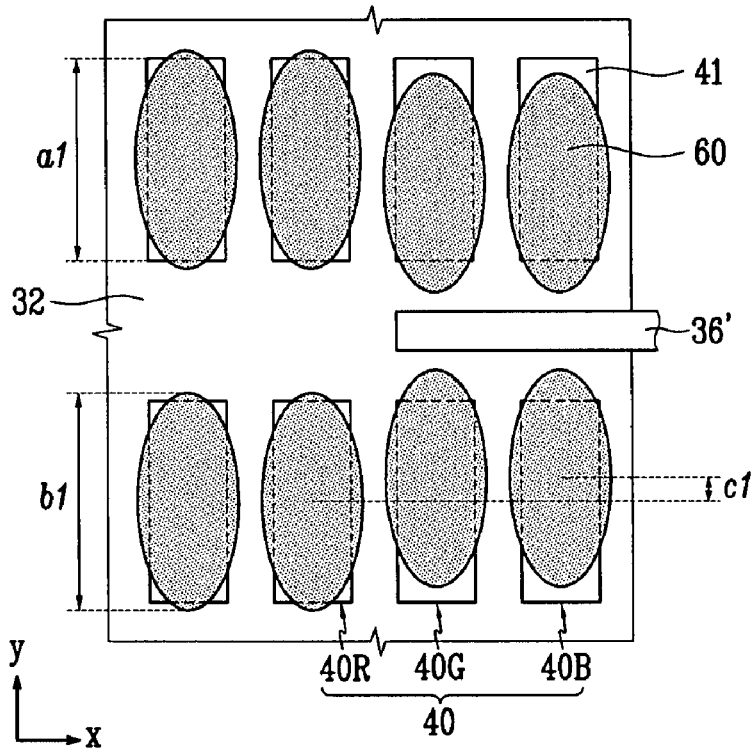
FIGS. 6-7 illustrate schematic partial bottom views of electron beam spots with respect to photoluminescent layers in comparative examples 1-2, respectively.
Figure 7:
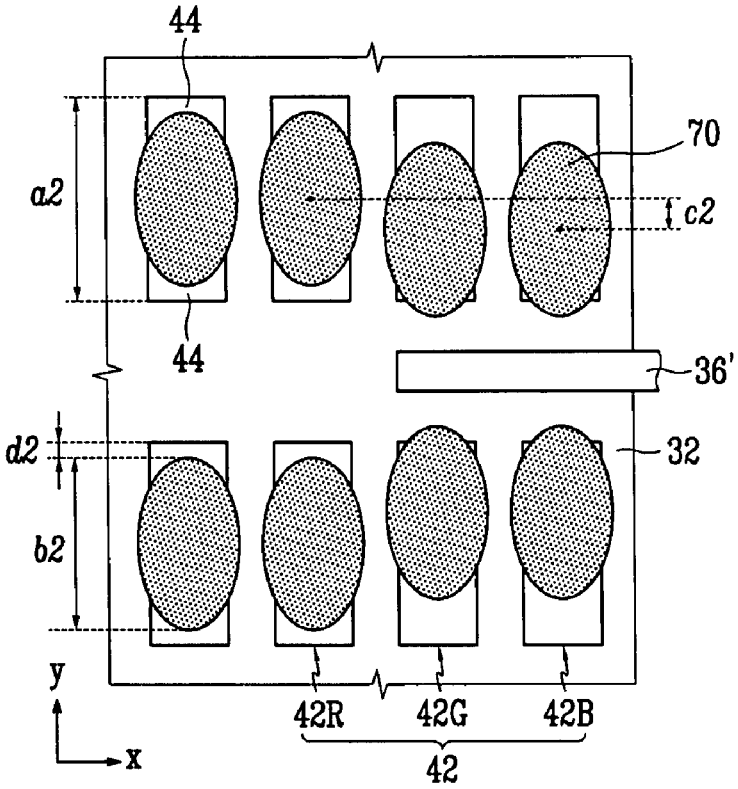

Comparative Examples 1-2 electron emission displays according to conventional art are formed, i.e., electron emission displays not having photoluminescent layers 30 satisfying Equation 1, as schematically illustrated in FIGS. 6-7. More specifically, as illustrated in FIG. 6, when a photoluminescent layer 40 is having a length "a1" along the second direction that is shorter than a magnitude "b1" of an electron beam spot 60 in the second direction, i.e., the photoluminescent layer 40 satisfies the condition a1<b1, a shifting distance "c1" of the electron beam spot 60 along the second direction due to charge of a spacer 36' may reduce an overlap area between the photoluminescent layers 40G/40B and the electron beam spot 60. More specifically, a color-lacking region 41 in the blue and green photoluminescent layers 40G/40B may be smaller that the color lacking region 41 in the red photoluminescent layer 40R. Accordingly, luminance of the photoluminescent layers 40G and 40B may be lower than the luminance of the red photoluminescent layer 40R. Such a non-uniform luminance may significantly reduce display quality of the electron emission display.

Similarly, as illustrated in FIG. 7, when a photoluminescent layer 42 satisfies the condition of d2<c2, the luminance of the electron emission display may be non-uniform. More specifically, even though a length "a2" along the second direction may be shorter than a magnitude "b2" of an electron beam spot 70 in the second direction, a shifting distance "c2" of the electron beam spot 70 along the second direction due to charge of the spacer 36' may reduce an overlap area between the photoluminescent layers 42G/42B and the electron beam spot 70. More specifically, a color-lacking region 44 in the blue and green photoluminescent layers 42G/42B may be smaller that the color lacking region 44 in the red photoluminescent layer 42R. Accordingly, luminance of the photoluminescent layers 44G and 44B may be lower than the luminance of the red photoluminescent layer 44R. Such a non-uniform luminance may significantly reduce display quality of the electron emission display. For example, if the shifting distances "c1" and "c2" of the electron beam spots 60 and 70, respectively, are more than 50 μm due to the electric charge of the spacer 36' in FIGS. 6-7, a luminance rate may be reduced by about 40% and about 20%, respectively.

Figure 8:
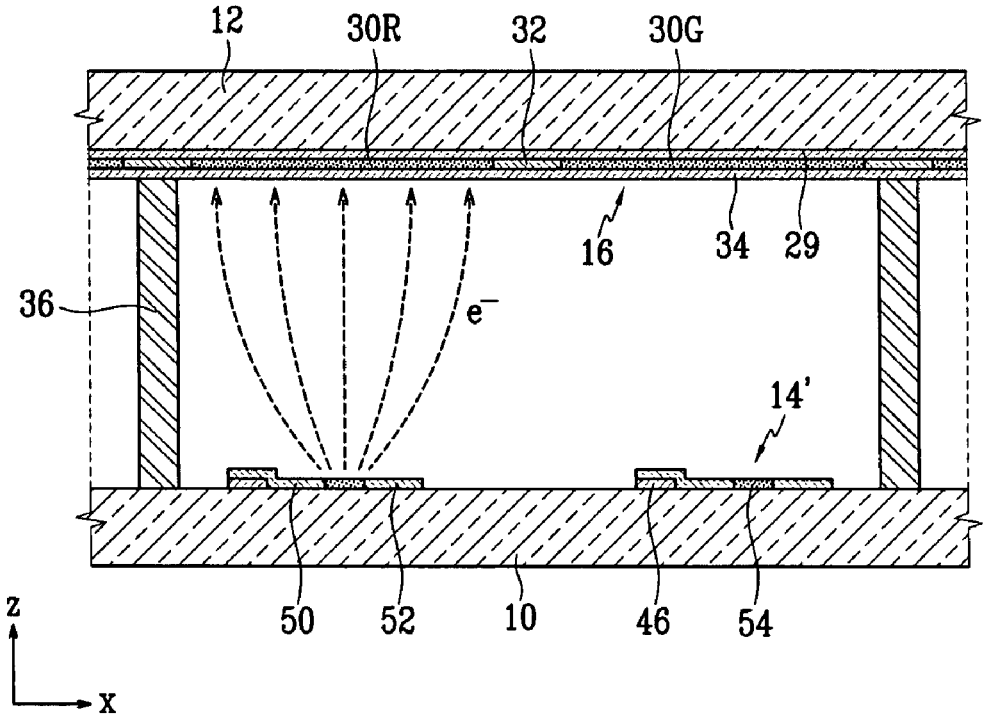
FIG. 8 illustrates a partial cross-sectional view of an electron emission display according to another embodiment of the present invention.
Figure 9:
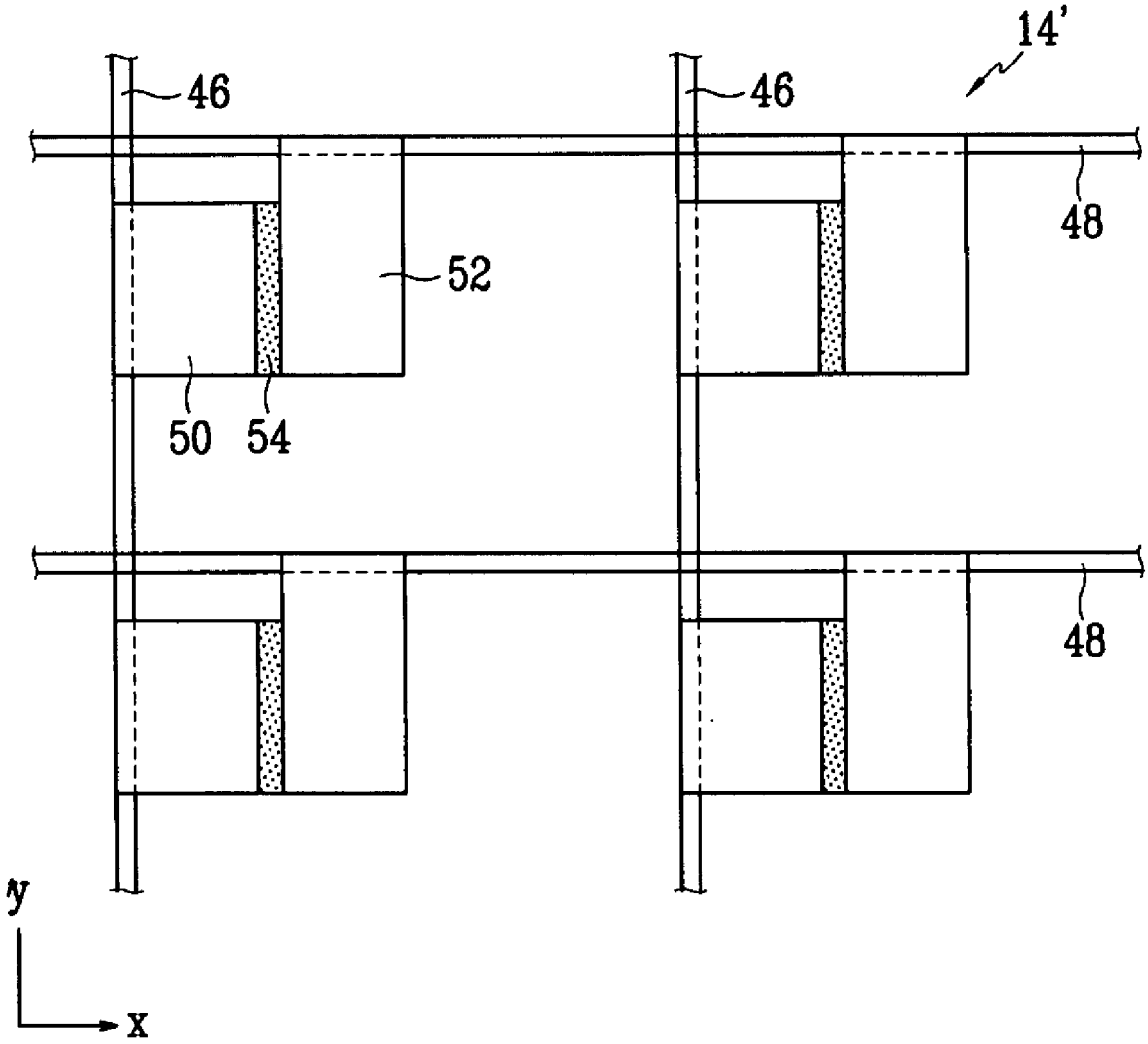
FIG. 9 illustrates a partial plan view of an electron emission unit in the electron emission display of FIG. 8.

According to another embodiment of the present invention illustrated in FIGS. 8-9, an electron emission display may be substantially similar to the electron emission display illustrated in FIGS. 1-3, with the exception of having an electron emission unit 14' with an array of surface-conduction emission (SCE) elements. Accordingly, description of the light emission unit 16 and the spacers 36 of the embodiment illustrated in FIGS. 8-9 will not be repeated herein.

The electron emission unit 14' may include a plurality of first electrodes 46 extending in the second direction on the first substrate 10, a plurality of second electrodes 48 extending in the first direction and insulated from the first electrodes 46, a plurality of first conductive layers 50 electrically connected to the first electrodes 46, a plurality of second conductive layers 52 electrically connected to the second electrodes 48 and spaced apart from the first conductive layers 50, and electron emission regions 54 between the first and second conductive layers 50 and 52. A structure including one first electrode 46 of the plurality of first electrodes 46, one second electrode 48 of the plurality of second electrodes, one first conductive layer 50 of the plurality of conductive layers 50, one second conductive layer 52 of the plurality of conductive layers 52, and at least one electron emission region 54 may form one SCE element, i.e., one sub-pixel.

The electron emission region 54 may be formed by fine cracks provided between the first and the second conductive layers 50 and 52. Alternatively, the electron emission region 54 may be a layer formed of a carbonaceous material, e.g., carbon nanotubes, graphite, graphite nanofibers, diamonds, diamond-like carbon, fullerene $C_{60}$, and combinations thereof. When voltages are applied to respective first and second electrodes 46 and 48, a current may flow in a direction parallel to an upper surface of the electron emission region 54 through the first and second conductive layers 50 and 52, thereby realizing the surface-conduction emission from the electron emission region 54.

In this respect, it should be noted that even though embodiments of the present invention were described with respect to electron emission display having FEA elements or SCE elements, other types of electron emission display elements, e.g., Metal-Insulator-Metal (MIM) elements, Metal-Insulator-Semiconductor (MIS) elements, and so forth, are included within the scope of the present invention.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission display, comprising:

an electron emission unit on a first substrate adapted to emit electron beam spots;

a light emission unit on a second substrate, the light emission unit including a plurality of photoluminescent layers and facing the electron emission unit; and a plurality of spacers between the first and second substrates along a first direction, wherein each photoluminescent layer of the plurality of photoluminescent layers satisfies a proviso that $(a-b)/2>c$, where "a" is a length of the photoluminescent layer in a second direction, "b" is a magnitude of an electron beam spot on the photoluminescent layer in the second direction, and "c" is a maximum shifting distance of the electron beam spot in the second direction.

2. The electron emission display as claimed in claim 1, wherein the electron emission unit includes field emission array elements.

3. The electron emission display as claimed in claim 2, wherein each photoluminescent layer corresponds to a respective field emission array element.

4. The electron emission display as claimed in claim 2, wherein the electron emission unit includes a plurality of first electrodes, a plurality of second electrodes intersecting a direction of the first electrodes, and electron emission regions electrically connected to the first or the second electrodes.

5. The electron emission display as claimed in claim 4, wherein the electron emission unit further comprises a third electrode above the first and second electrodes.

6. The electron emission display as claimed in claim 1, wherein the electron emission unit includes surface-conduction emission elements.

7. The electron emission display as claimed in claim 6, wherein each photoluminescent layer corresponds to a respective surface-conduction emission elements.

8. The electron emission display as claimed in claim 6, wherein the electron emission unit includes a plurality of first electrodes, a plurality of second electrodes intersecting a direction of the first electrodes, first conductive layers electrically connected to the first electrodes, second conductive layers electrically connected to the second electrodes, and electron emission regions between the first and second conductive layers.

9. The electron emission display as claimed in claim 1, wherein the light emission unit further comprises black layers between the photoluminescent layers.

10. The electron emission display as claimed in claim 9, wherein the light emission unit further comprises a reflection layer in communication with the photoluminescent layers and the black layers.

11. The electron emission display as claimed in claim 1, wherein the plurality of photoluminescent layers is arranged in a matrix pattern.

12. The electron emission display as claimed in claim 11, wherein the photoluminescent layers are spaced apart from each other and arranged in a plurality of arrays along the first direction.

13. The electron emission display as claimed in claim 12, wherein each spacer is perpendicular to the photoluminescent layers.

14. The electron emission display as claimed in claim 12, wherein each spacer is between arrays of the photoluminescent layers.

15. The electron emission display as claimed in claim 14, wherein each spacer is between two arrays of the photoluminescent layers.

16. The electron emission display as claimed in claim 14, wherein the spacer has a long rod-type structure.

17. The electron emission display as claimed in claim 14, wherein the spacer has a cylindrical structure.

18. The electron emission display as claimed in claim 14, wherein the spacer has a short rod-type structure.

19. The electron emission display as claimed in claim 1, wherein each photoluminescent layer has a rectangular shape.

20. The electron emission display as claimed in claim 1, further comprising a sealing member affixing the first and second substrates to provide a vacuum environment therebetween.

* * * * *